US007183489B2

(12) United States Patent
Kossak et al.

(10) Patent No.: US 7,183,489 B2
(45) **Date of Patent: *Feb. 27, 2007**

(54) MULTI-PORT COMPRESSION CONNECTOR

(75) Inventors: Robert W. Kossak, Lemont, IL (US); Joseph A. Chopp, Jr., New Lenox, IL (US); Robert L. Sokol, Orland Park, IL (US); Steven R. Bitz, Mokena, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/430,322

(22) Filed: May 9, 2006

(65) Prior Publication Data

US 2006/0201695 A1 Sep. 14, 2006

Related U.S. Application Data

(63) Continuation of application No. 10/981,371, filed on Nov. 4, 2004, now Pat. No. 7,053,307, which is a continuation-in-part of application No. 10/669,391, filed on Sep. 24, 2003, now Pat. No. 6,846,989.

(51) Int. Cl.
*H01R 13/44* (2006.01)

(52) U.S. Cl. ..... 174/84 R; 174/84 C; 439/877

(58) Field of Classification Search ..... 174/74 R, 174/71 R, 84 R, 84 C, 94 R; 439/98, 877, 439/882

See application file for complete search history.

(56) References Cited

U.S. PATENT DOCUMENTS

| | | | | |
|---|---|---|---|---|
| 2,938,069 | A | | 5/1960 | Toedtman et al. |
| 2,956,108 | A | | 10/1960 | Brenner |
| 2,964,585 | A | | 12/1960 | Nilsson et al. |
| 3,009,987 | A | | 11/1961 | Brenner |
| 3,322,888 | A | * | 5/1967 | Zemels ..... 174/94 R |
| 3,340,352 | A | | 9/1967 | Teagno et al. |
| 3,354,517 | A | * | 11/1967 | Levinsky ..... 403/275 |
| 3,746,777 | A | | 7/1973 | Peek |
| 4,350,843 | A | | 9/1982 | Campbell et al. |
| 5,036,164 | A | | 7/1991 | Schrader et al. |
| 5,103,068 | A | * | 4/1992 | Schrader ..... 174/94 R |

(Continued)

FOREIGN PATENT DOCUMENTS

| | | |
|---|---|---|
| DE | 1277975 | 9/1968 |

(Continued)

OTHER PUBLICATIONS

FCI Framatome Group, Bumdy Products Catalog, p. C-103, date unknown.

*Primary Examiner*—William H. Mayo, III
(74) *Attorney, Agent, or Firm*—Robert A. McCann; Christopher S. Clancy

(57) ABSTRACT

The compression connector has a first body portion including a first hook and a first ramp extending therefrom to form a first main wire port. The first body portion also has a second hook and a second ramp extending therefrom to form a first tap wire port. The first body portion further has a second tap wire port and a third tap wire port positioned between the first main wire port and the first tap wire port.

5 Claims, 13 Drawing Sheets

U.S. PATENT DOCUMENTS

| | | | | |
|---|---|---|---|---|
| 5,200,576 | A * | 4/1993 | Schrader et al. | 174/94 R |
| 5,635,676 | A * | 6/1997 | Piriz | 174/84 C |
| 6,261,137 | B1 | 7/2001 | Wilcox | |
| 6,452,103 | B1 * | 9/2002 | Piriz et al. | 174/84 C |
| 6,486,403 | B1 * | 11/2002 | Connor | 174/84 C |
| 6,525,270 | B1 * | 2/2003 | Connor et al. | 174/84 C |
| 6,538,204 | B2 * | 3/2003 | Connor | 174/84 R |
| 6,552,271 | B2 * | 4/2003 | Connor et al. | 174/84 R |
| 6,818,830 | B2 | 11/2004 | O'Grady et al. | |

FOREIGN PATENT DOCUMENTS

| | | | |
|---|---|---|---|
| EP | 468378 | A1 | 1/1992 |

* cited by examiner

MULTI-PORT COMPRESSION CONNECTOR

CROSS-REFERENCE TO RELATED APPLICATIONS

This application is a continuation of U.S. application Ser. No. 10/981,371, filed on Nov. 4, 2004, now U.S. Pat. No. 7,053,307, which is a continuation-in-part of U.S. application Ser. No. 10/699,391, filed on Sep. 24, 2003, now U.S. Pat. No. 6,846,989.

BACKGROUND OF THE INVENTION

The present invention is directed to multi-port compression connectors and, more particularly, to split multi-port compression connectors that can accommodate different size main run and tap wires.

Examples of multi-port compression connectors can be found in the following U.S. Pat. Nos. 2,956,108; 5,103,068; 5,200,576; 6,452,103; 6,486,403; 6,525,270; 6,538,204; and 6,552,271. However, none of these prior art compression connectors have two small tap wire ports positioned between a main wire port and a large tap wire port.

SUMMARY OF THE INVENTION

It would be desirable to provide a multi-port compression connector having increased wire pullout strength.

It would also be desirable to provide a multi-port compression connector having improved retention of tap wires before and during the crimping operation.

It would further be desirable to provide a multi-port compression connector having two small tap wire ports positioned between a main wire port and a large tap wire port.

A compression connector for securing wires therein is disclosed. The compression connector has a first body portion including a first hook and a first ramp extending therefrom to form a first main wire port. The first body portion also has a second hook and a second ramp extending therefrom to form a first tap wire port. The first body portion further has a second tap wire port and a third tap wire port positioned between the first main wire port and the first tap wire port.

Preferably, the first tap wire port is larger than the second tap wire port and the third tap wire port, and the second tap wire port is larger than the third tap wire port. Alternatively, the second tap wire port and the third tap wire port are substantially the same size. Moreover, the second tap wire port and the third tap wire port are teardrop-shaped.

Preferably, the first body portion includes a bump extending from a back side of the second hook. The first body portion further includes a notch and a tab adjacent either the second tap wire port or the third tap wire port. Alternatively, the first body portion includes an aperture adjacent either the second tap wire port or the third tap wire port. Additionally, the second tap wire port or the third tap wire port includes a blend.

Preferably, the compression connector includes a second body portion connected to the first body portion. The second body portion includes a third hook and a third ramp extending therefrom to form a second main wire port. The second body portion also includes a fourth hook and a fourth ramp extending therefrom to form a fourth tap wire port. Additionally, the second body portion includes a fifth tap wire port and a sixth tap wire port positioned between the second main wire port and the fourth tap wire port.

DETAILED DESCRIPTION OF PREFERRED EMBODIMENTS

Figure 1:
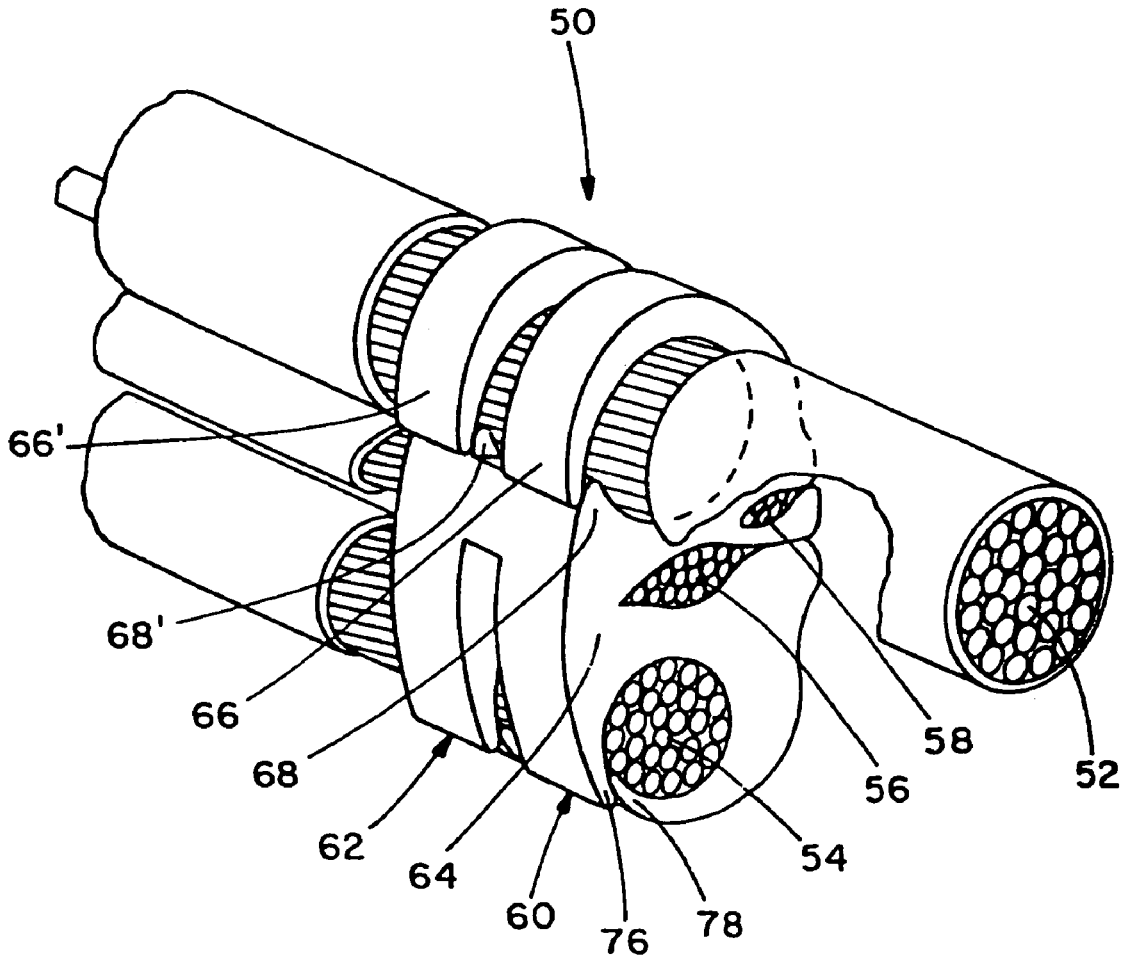
FIG. 1 is a left front perspective view of a compression connector according to a first embodiment of the present invention, shown secured around main line wires after crimping three different sized tap wires.
Figure 2:
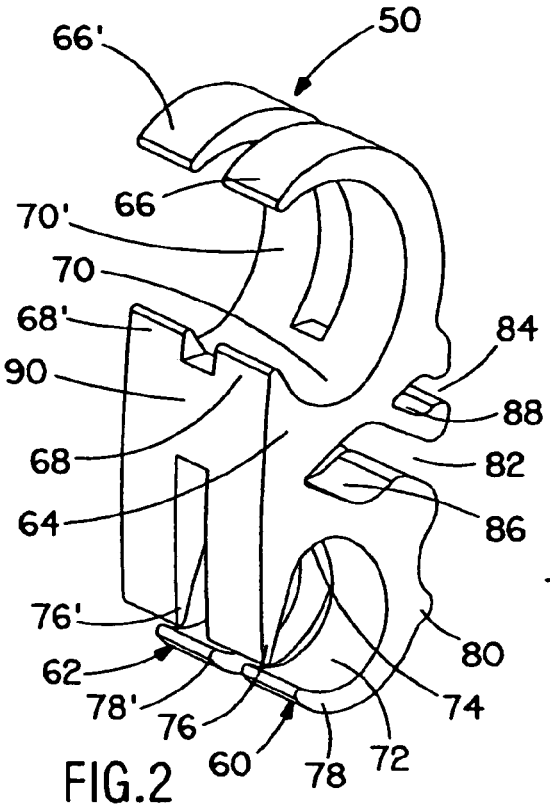
FIG. 2 is a left front perspective view of the compression connector of FIG. 1.
Figure 3:
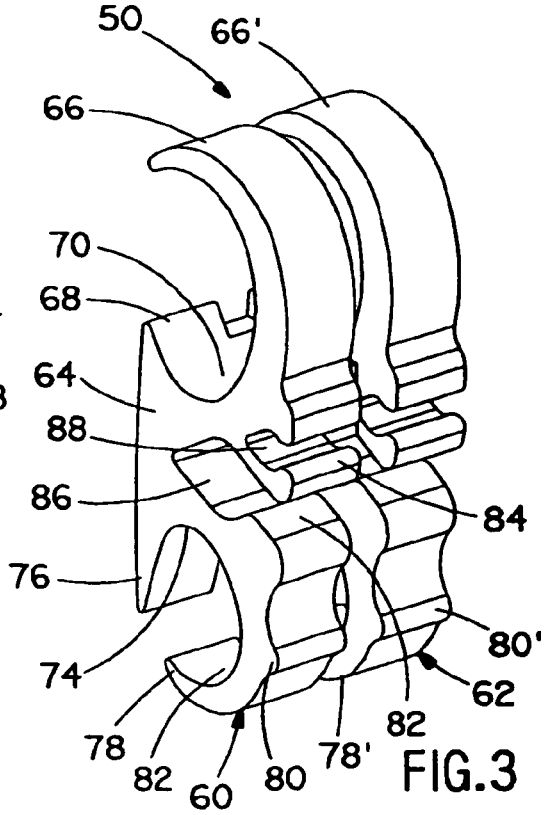
FIG. 3 is a right side perspective view of the compression connector of FIG. 1.

The illustrated embodiments of the invention are directed to split multi-port compression connectors having range-taking ports for multiple wires, usually main run wires and two or more tap wires. Each of the compression connector ports accepts a range of wire sizes falling within certain limits, and the range may be different for each port. FIGS. 1–8 are directed to compression connector 50, FIGS. 9–12 are directed to compression connector 150, FIGS. 13–16 are directed to compression connector 250, FIGS. 17–20 are directed to compression connector 350, FIGS. 21–24 are directed to compression connector 450, FIGS. 25–28 are directed to compression connector 550, FIGS. 29–32 are directed to compression connector 650, FIGS. 33–40 are directed to compression connector 750, and FIGS. 41–44 are directed to compression connector 850.

FIG. 1 shows a split multi-port compression connector 50 secured around main line wires 52 and tap wires 54, 56, 58, after crimping. Preferably, compression connector 50 is a one-piece member made of electrically conductive material, such as copper. However, it is likewise contemplated that compression connector 50 may be made of any suitable materials or elements that will withstand a crimping operation.

Figure 4:
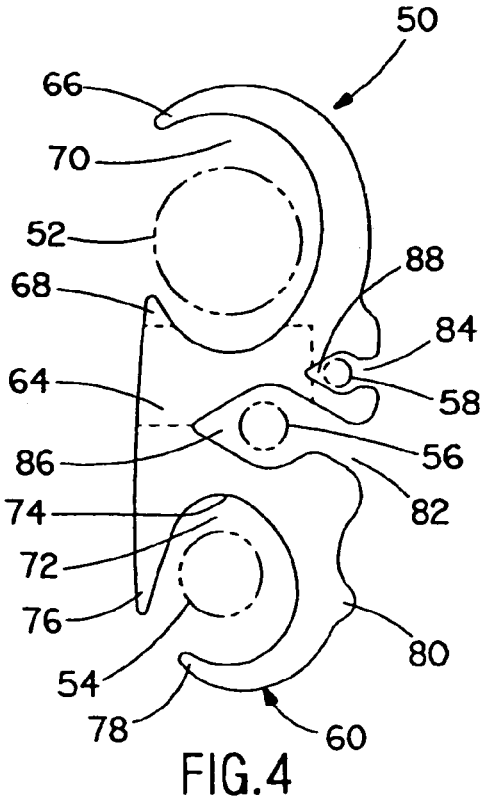
FIG. 4 is a front view of the compression connector of FIG. 1.
Figure 6:
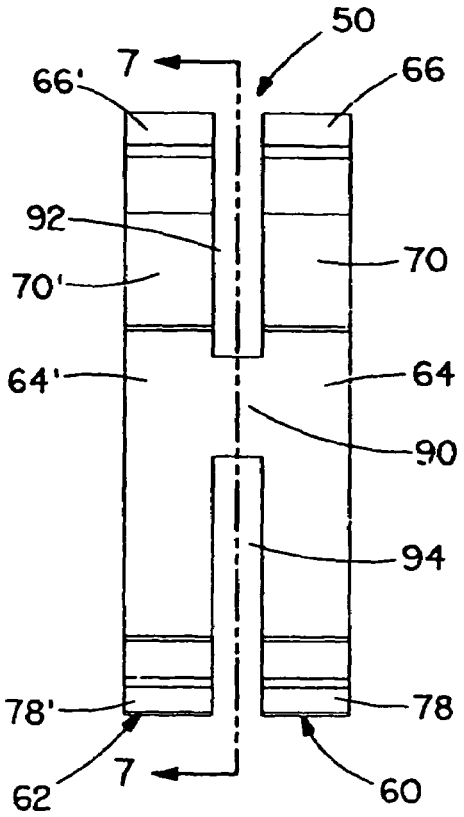
FIG. 6 is a left side view of the compression connector of FIG. 1.
Figure 7:
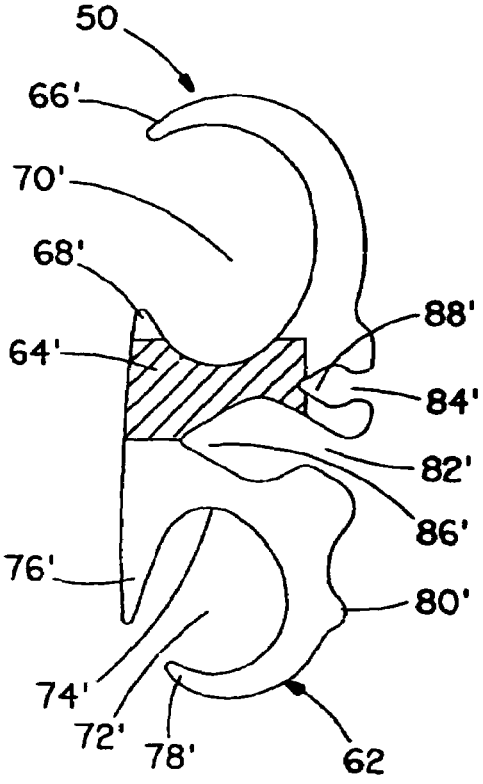
FIG. 7 is a cross-sectional view taken along lines 7—7 of FIG. 6.
Figure 8:
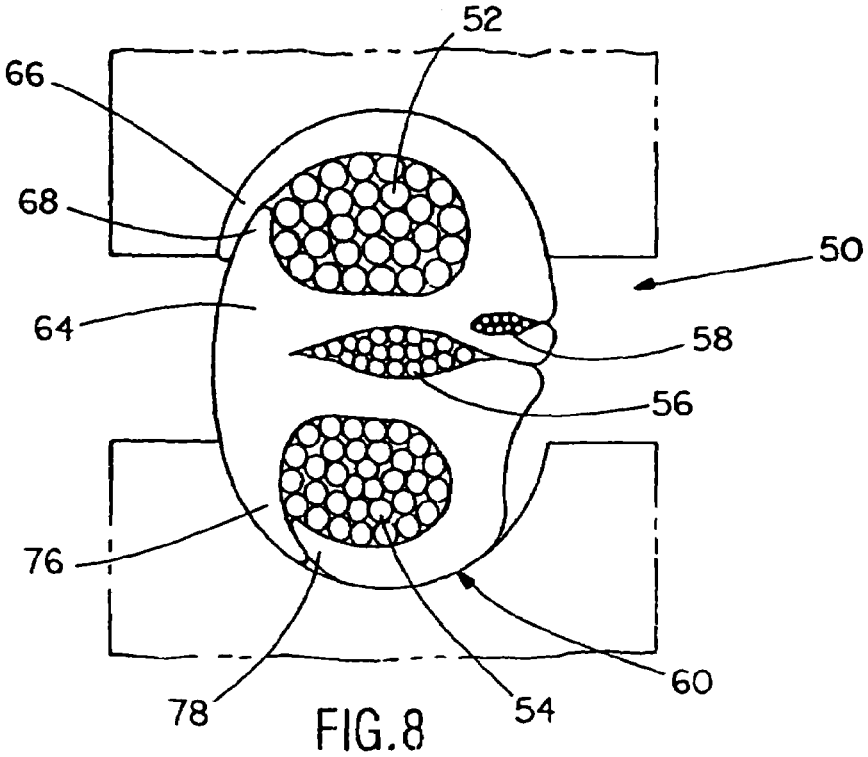
FIG. 8 is a front view of the compression connector of FIG. 1, after crimping three different sized tap wires.
Figure 9:
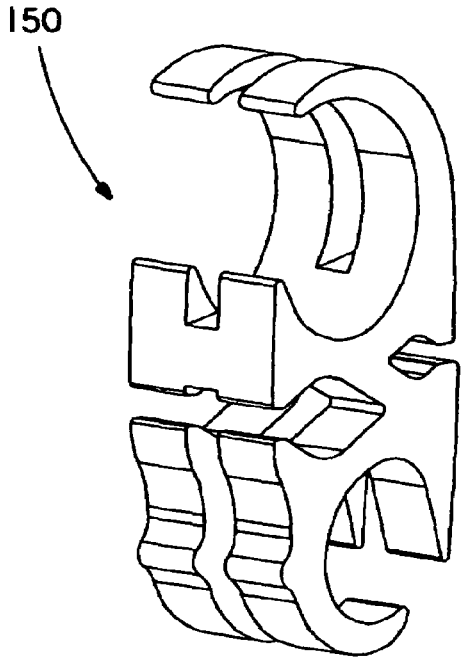
FIG. 9 is a left front perspective view of a compression connector according to a second embodiment of the present invention.
Figure 10:
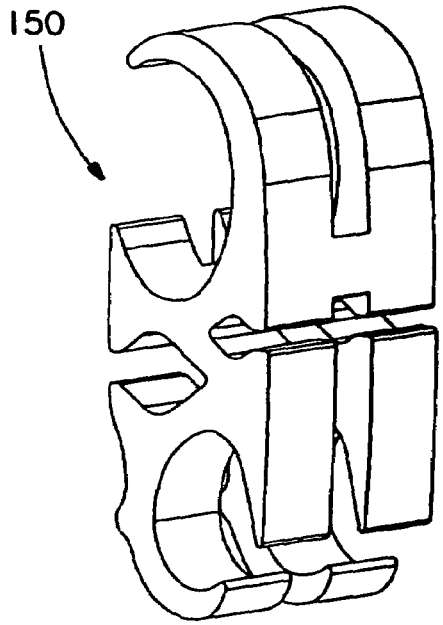
FIG. 10 is a right side perspective view of the compression connector of FIG. 9.
Figure 11:
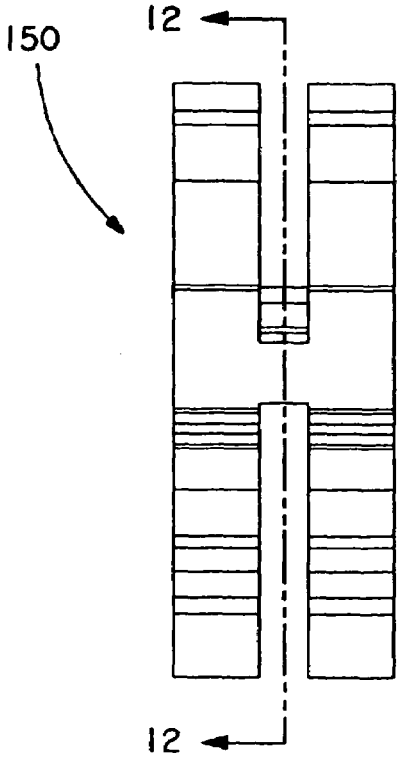
FIG. 11 is a left side view of the compression connector of FIG. 9.
Figure 12:
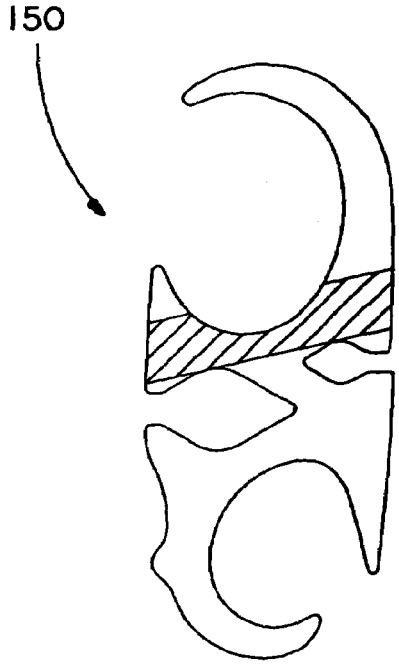
FIG. 12 is a cross-sectional view taken along lines 12—12 of FIG. 11.

As shown in FIGS. 2–7, compression connector 50 has a first section 60 and a second section 62. As best seen in FIG. 4, first section 60 includes body portion 64 having a hook 66 and a ramp 68 extending therefrom to form main wire port 70 in which main line wires 52 can be placed. Preferably, hook 66 is C-shaped. As shown in FIG. 8, when the crimping dies close on compression connector 50, hook 66 wraps around main line wires 52 and against the outside of ramp 68, to provide a continuous contact surface along substantially the entire circumference of main line wires 52. Although FIG. 8 shows compression connector 50 crimped with hook 66 locking against the outside of ramp 68, it is likewise contemplated that compression connector 50 may be crimped with hook 66 locking against the inside of ramp 68.

As best seen in FIG. 4, first section 60 has a tap wire port 72 extending from body portion 64. Preferably, tap wire port 72 is substantially oval, with one end slightly narrower than the other. Narrow end 74 nests tap wires 54 before crimping and is pointed inward and towards the top of compression connector 50. Ramp 76 extends from narrower end 74 toward the bottom of compression connector 50. The wider end of tap wire port 72 is pointed downward and is enclosed by hook 78 that comprises the bottom of compression connector 50. Hooks 66, 78 provide two contact points with the crimping dies (not shown) prior to crimping. Bump 80 extends from the back of hook 78, but does not come into contact with the crimping dies prior to crimping. Bump 80 provides an additional pressure point during the later phase of the crimping process, which results in less distortion of the crimped wires than in prior art compression connectors.

As best seen in FIG. 4, first section 60 has two non-planar and non-parallel sides, each comprising one or more curved segments and separated by slots 82, 84 extending from tap wire ports 86, 88, respectively. The compression connector sides are both curved, slightly offset, and tilted with respect to one another, such that the configuration compensates for connector distortion during the crimping process and, thus, results in less shape irregularities in the crimped connector. Preferably, tap wire ports 86, 88 are teardrop or diamond shaped and are located at the middle portion of compression connector 50. Although, as shown in FIGS. 1–8, tap wire ports 86, 88 are different sizes, it is likewise contemplated that tap wire ports 86, 88 can be the same size.

Second section 62 is identical to first section 60. Accordingly, the same numerals utilized to describe first section 60 will be utilized to describe second section 62, with the addition of the prime (') notation. As best seen in FIG. 7, second section 62 includes body portion 64' having a hook 66' and a ramp 68' extending therefrom to form main wire port 70' in which main line wires 52 can be placed. Preferably, hook 66' is C-shaped. As shown in FIG. 1, when the crimping dies close on compression connector 50, hook 66' wraps around main line wires 52 and against the outside of ramp 68', to provide a continuous contact surface along substantially the entire circumference of main line wires 52. Although FIG. 1 shows compression connector 50 crimped with hook 66' locking against the outside of ramp 68', it is likewise contemplated that compression connector 50 may be crimped with hook 66' locking against the inside of ramp 68'.

As best seen in FIG. 7, second section 62 has a tap wire port 72' extending from body portion 64'. Preferably, tap wire port 72' is substantially oval, with one end slightly narrower than the other. Narrow end 74' nests tap wires 54 before crimping and is pointed inward and toward the top of compression connector 50. Ramp 76' extends from narrower end 74' toward the bottom of compression connector 50. The wider end of tap wire port 72' is pointed downward and is enclosed by hook 78' that comprises the bottom of compression connector 50. Hooks 66', 78' provide two contact points with the crimping dies (not shown) prior to crimping. Bump 80' extends from the back of hook 78', but does not come in contact with the crimping dies prior to crimping. Bump 80' provides an additional pressure point during the later phase of the crimping process, which results in less distortion of the crimped wires than in prior art compression connectors.

Figure 5:
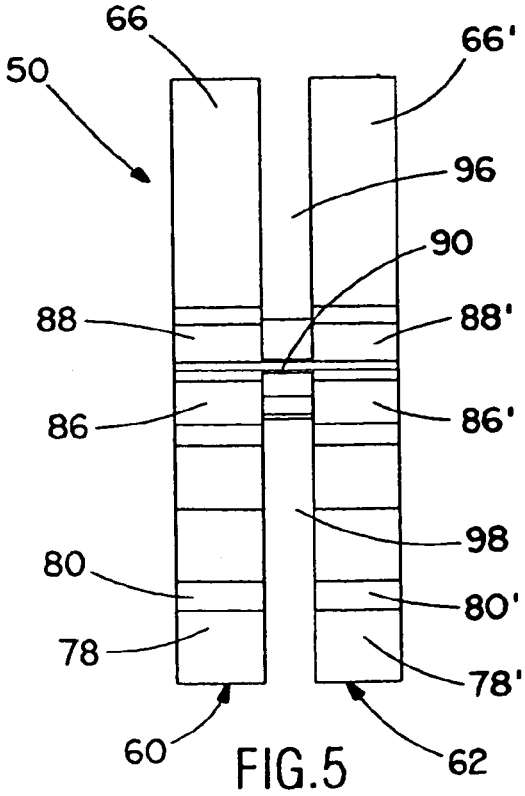
FIG. 5 is a right side view of the compression connector of FIG. 1.

As best seen in FIG. 7, second section 62 has two non-planar and non-parallel sides, each comprising one or more curved segments and separated by slots 82', 84' extending from tap wire ports 86', 88', respectively. The compression connector sides are both curved, slightly offset, and tilted with respect to one another, such that the configuration compensates for connector distortion during the crimping process and, thus, results in less shape irregularities in the crimped connector. Preferably, tap wire ports 86', 88' are located at the middle portion of compression connector 50. Although, as shown in FIGS. 1–8, tap wire ports 86', 88' are different sizes, it is likewise contemplated that tap wire ports 86', 88' can be the same size. As shown in FIGS. 5 and 6, central body portion 90 connects body portion 64 and body portion 64'.

As best seen in FIGS. 5 and 6, compression connector 50 includes four slots 92, 94, 96, 98 cut through compression connector 50. Slots 92, 94, 96, 98 provide space to loop a cable tie (not shown) to secure main line wires 52 and tap wires 54, 56, 58 to compression connector 50 before crimping, as disclosed in co-pending U.S. Ser. No. 10/668,847, now U.S. Pat. No. 6,818,830, the disclosure of which is incorporated by reference in its entirety. Although FIGS. 1–8 show compression connector 50 having slots 92, 94, 96, 98, it is likewise contemplated that compression connector 50 may not have any slots.

A second embodiment of the present invention is illustrated in FIGS. 9–12. As shown in FIGS. 9–12, a split multi-port compression connector 150 is substantially the same as compression connector 50 illustrated in FIGS. 1–8, except that hooks 66, 78 are facing opposite sides of compression connector 150. Likewise, hooks 66', 78' are facing opposite sides of compression connector 150. As a result, tap wire ports 86, 88 are on opposite sides of compression connector 150. Likewise, tap wire ports 86', 88' are on opposite sides of compression connector 150. However, compression connector 150 functions similarly to compression connector 50 illustrated in FIGS. 1–8.

A third embodiment of the present invention is illustrated in FIGS. 13–16. As shown in FIGS. 13–16, a split multi-tap compression connector 250 is substantially the same as compression connector 150 illustrated in FIGS. 9–12, with the addition of a notch 252 and a tab 254 at the smallest wire port entrance. The addition of notch 252 and tab 254 increases the pullout force of extremely small wires crimped in one of the range-taking ports. Upon crimping, tab 254 yields under the pressure exerted by the opposite sides of the wire port entrance and is pushed into notch 252 with little resistance and, thus, results in a tighter collapse of the entire wire port. Although notch 252 and tab 254 are shown below the smallest port entrance, it is likewise contemplated that notch 252 and tab 254 may be positioned above the smallest port entrance.

Figure 13:
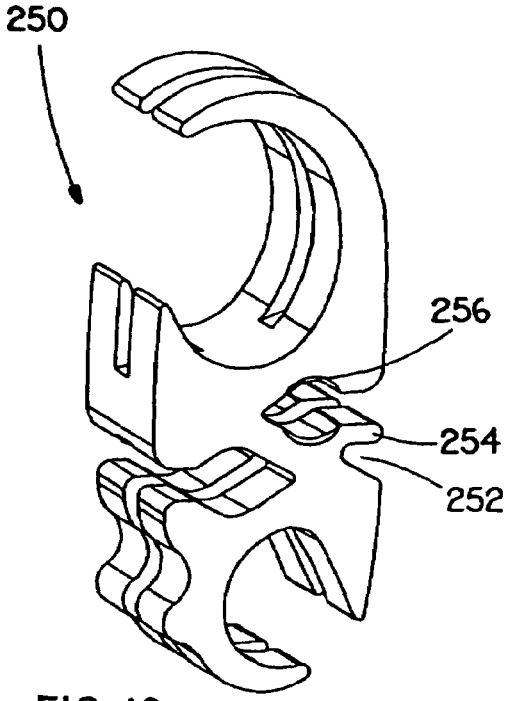
FIG. 13 is a left front perspective view of a compression connector according to a third embodiment of the present invention.
Figure 14:
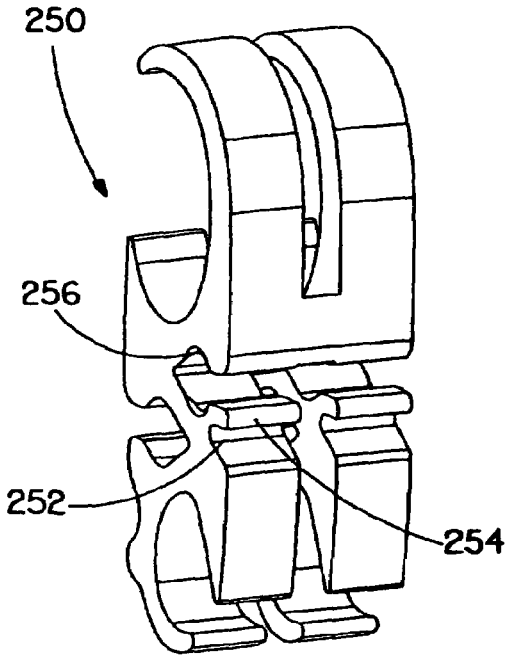
FIG. 14 is a right side perspective view of the compression connector of FIG. 13.
Figure 15:
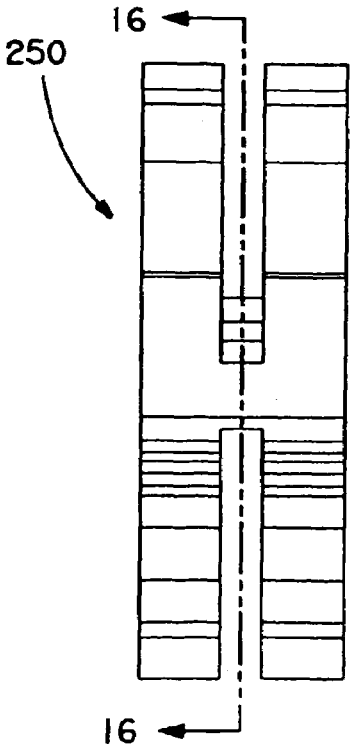
FIG. 15 is a left side view of the compression connector of FIG. 13.
Figure 16:
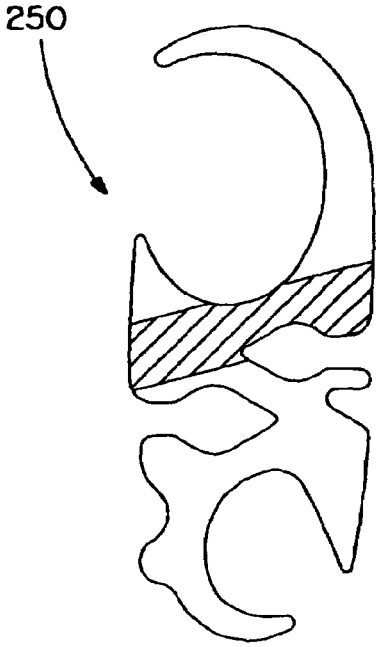
FIG. 16 is a cross-sectional view taken along lines 16—16 of FIG. 15.
Figure 17:
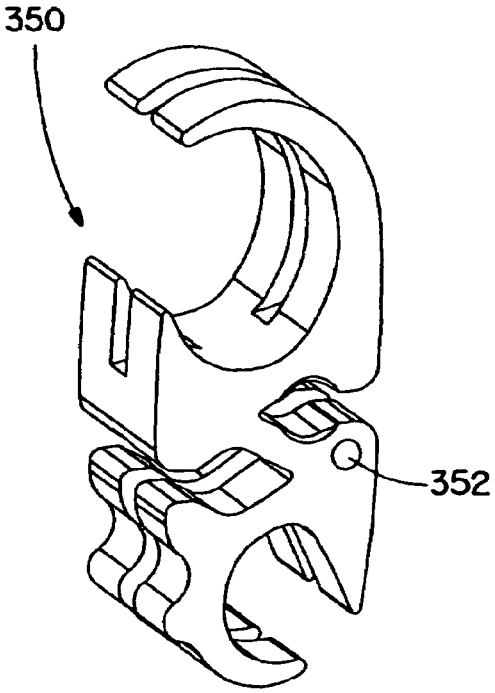
FIG. 17 is a left front perspective view of a compression connector according to a fourth embodiment of the present invention.
Figure 18:
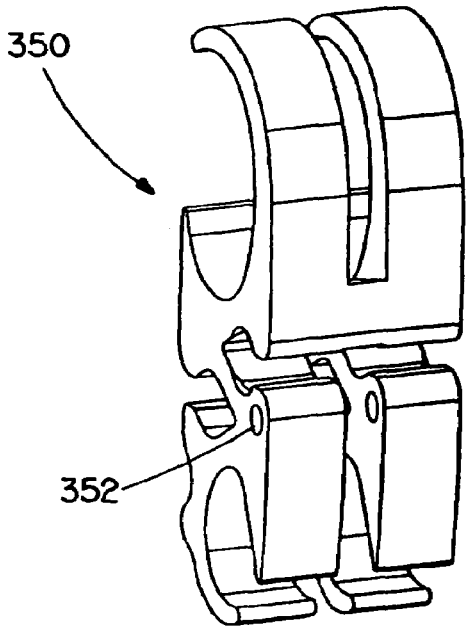
FIG. 18 is a right side perspective view of the compression connector of FIG. 17.
Figure 19:
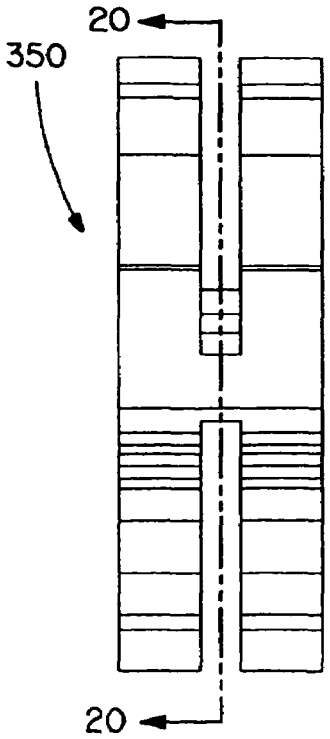
FIG. 19 is a left side view of the compression connector of FIG. 17.
Figure 20:
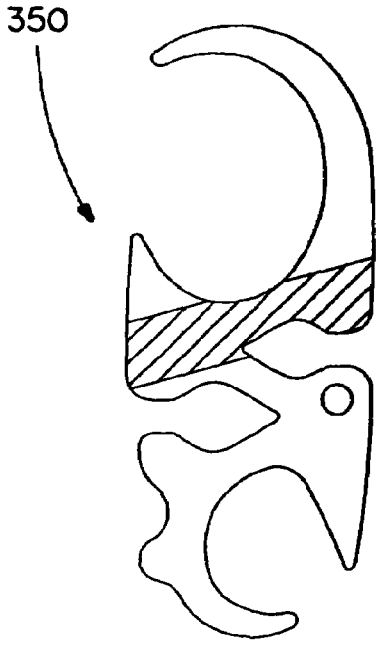
FIG. 20 is a cross-sectional view taken along lines 20—20 of FIG. 19.
Figure 21:
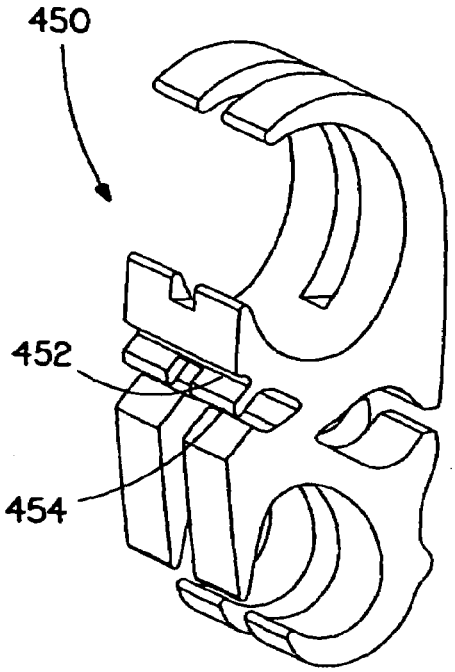
FIG. 21 is a left front perspective view of a compression connector according to a fifth embodiment of the present invention.
Figure 22:
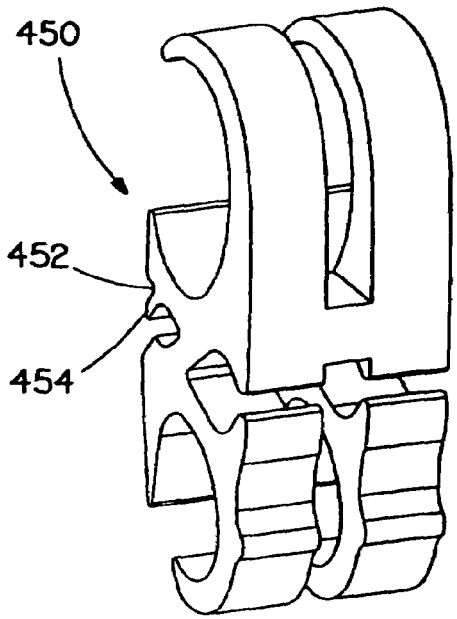
FIG. 22 is a right side perspective view of the compression connector of FIG. 21.
Figure 23:
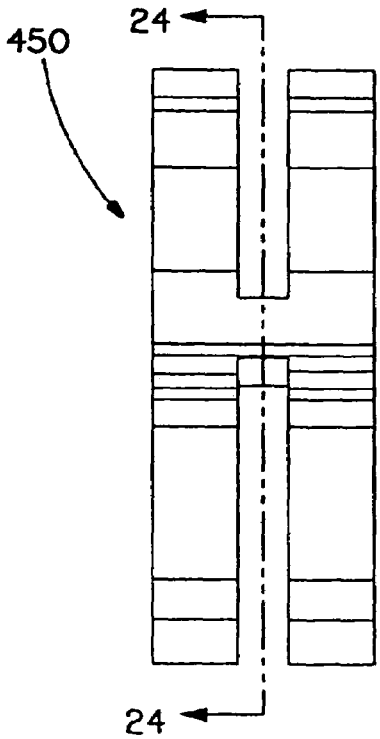
FIG. 23 is a left side view of the compression connector of FIG. 21.
Figure 24:
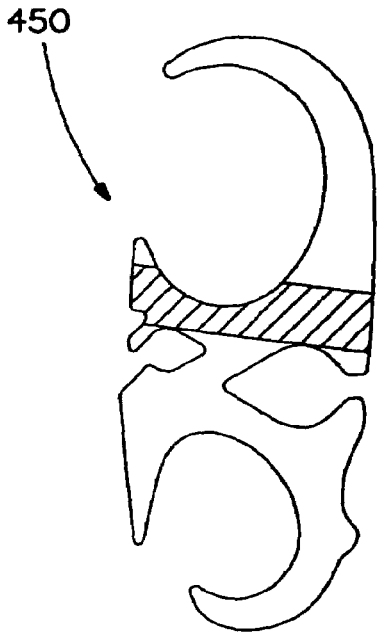
FIG. 24 is a cross-sectional view taken along lines 24—24 of FIG. 23.
Figure 25:
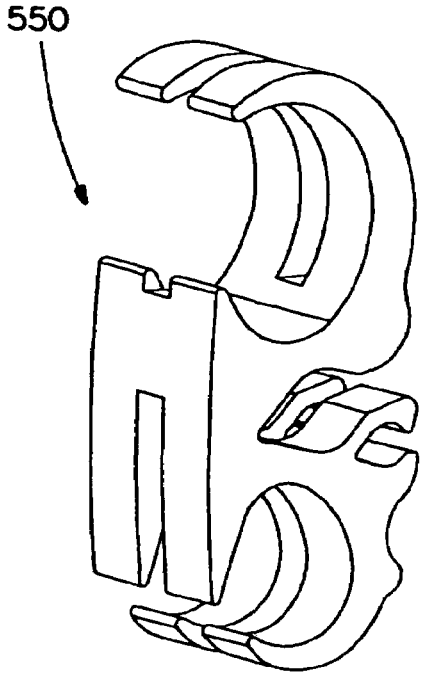
FIG. 25 is a left front perspective view of a compression connector according to a sixth embodiment of the present invention.
Figure 26:
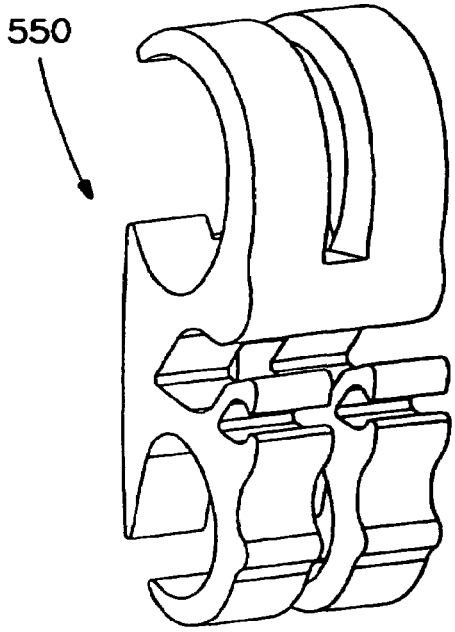
FIG. 26 is a right side perspective view of the compression connector of FIG. 25.
Figure 27:
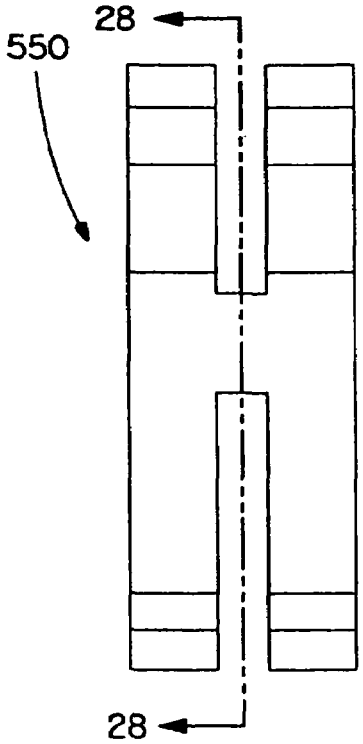
FIG. 27 is a left side view of the compression connector of FIG. 25.
Figure 28:
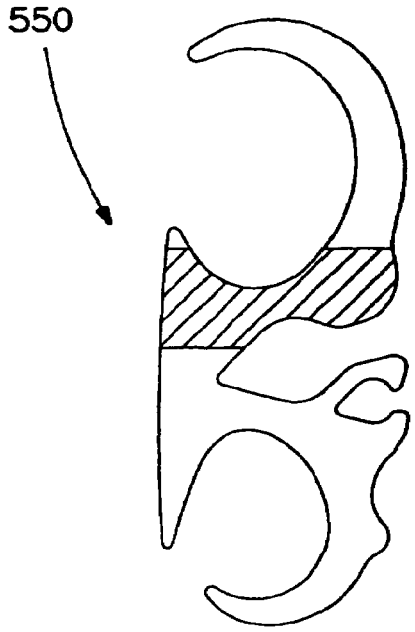
FIG. 28 is a cross-sectional view taken along lines 28—28 of FIG. 27.
Figure 29:
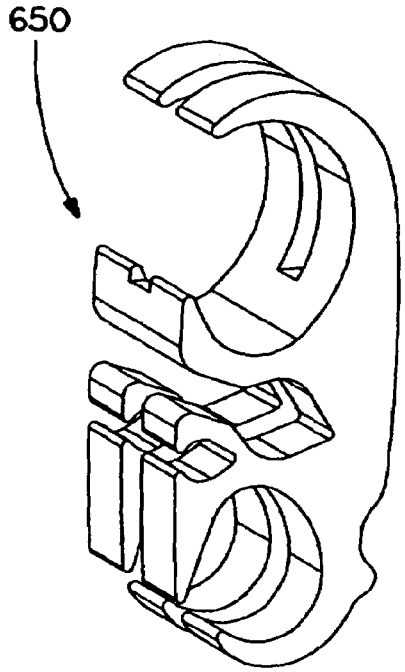
FIG. 29 is a left front perspective view of a compression connector according to a seventh embodiment of the present invention.
Figure 30:
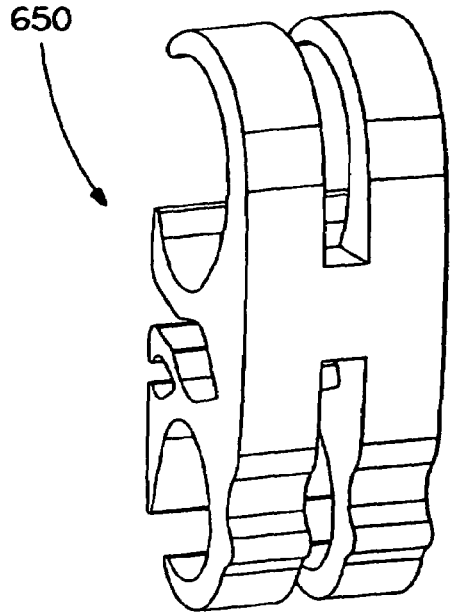
FIG. 30 is a right side perspective view of the compression connector of FIG. 29.
Figure 31:
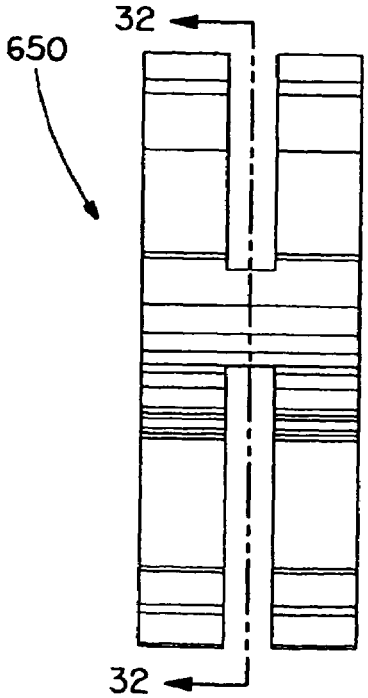
FIG. 31 is a left side view of the compression connector of FIG. 29.
Figure 32:
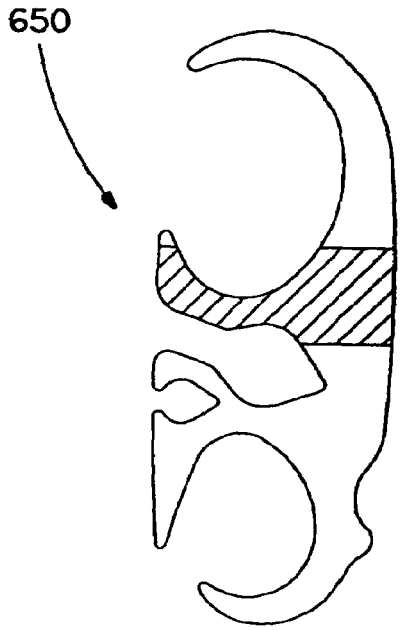
FIG. 32 is a cross-sectional view taken along lines 32—32 of FIG. 31.
Figure 33:
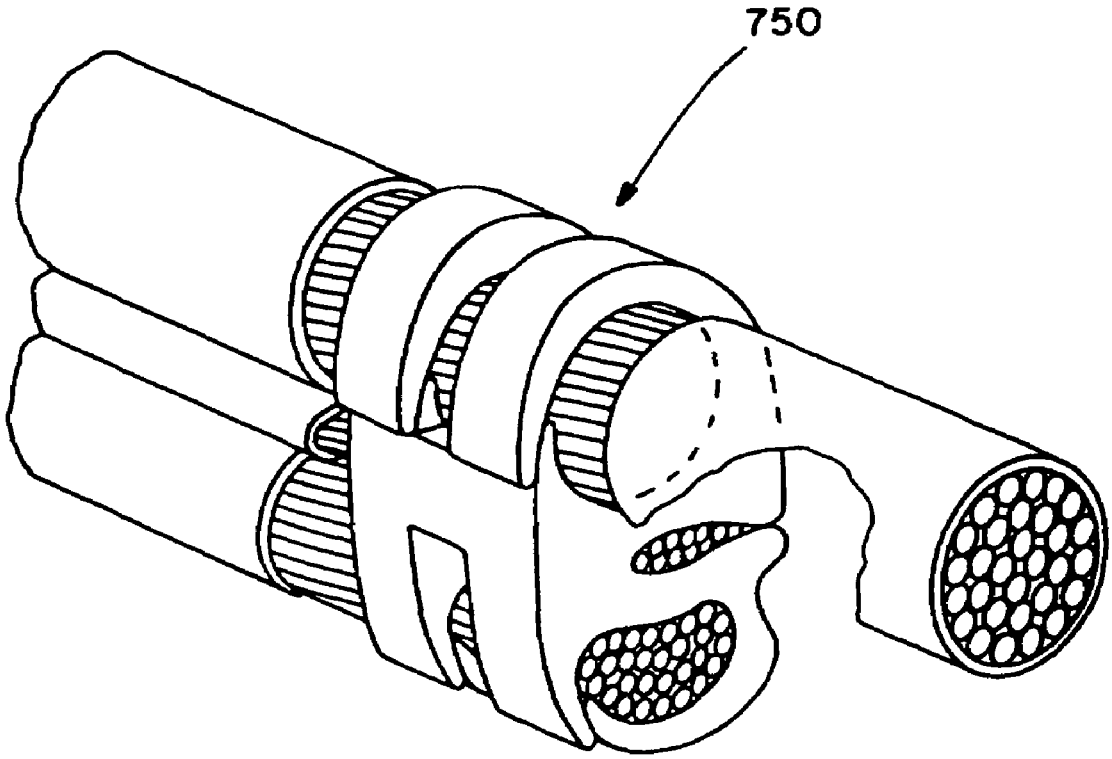
FIG. 33 is a left front perspective view of a compression connector according to an eighth embodiment of the present invention, shown secured around main line wires after crimping two different sized tap wires.
Figure 34:
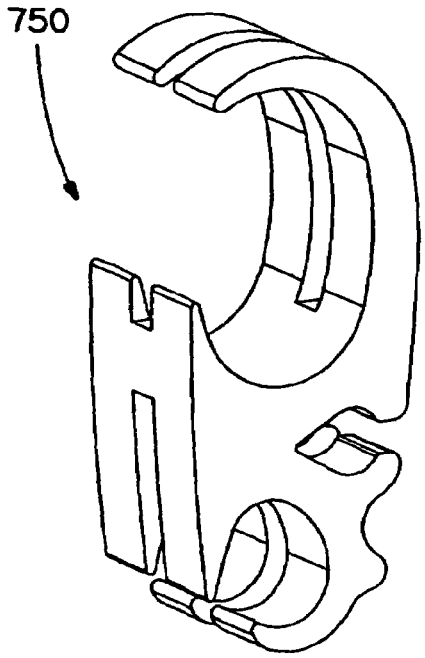
FIG. 34 is a left front perspective view of the compression connector of FIG. 33.
Figure 35:
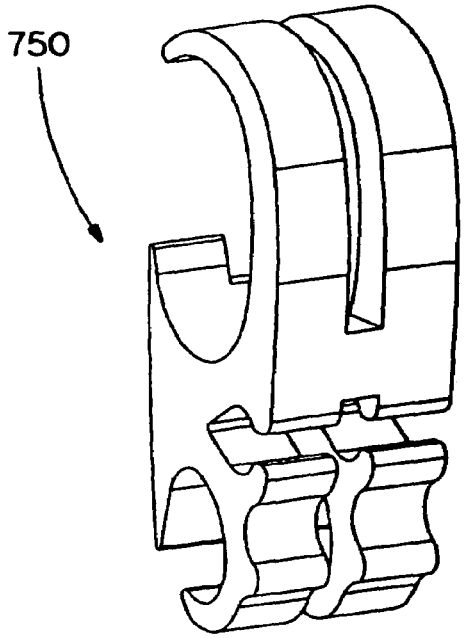
FIG. 35 is a right side perspective view of the compression connector of FIG. 33.
Figure 36:
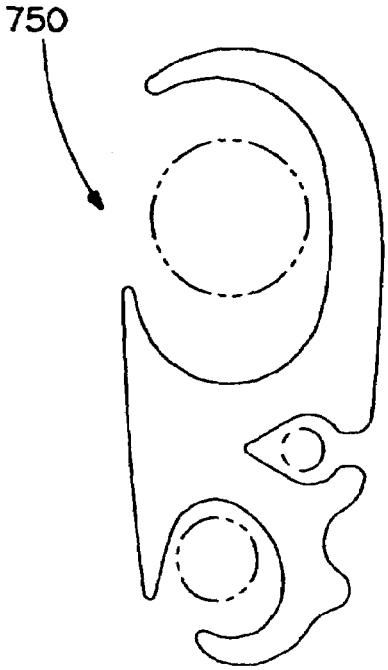
FIG. 36 is a front view of the compression connector of FIG. 33.
Figure 37:
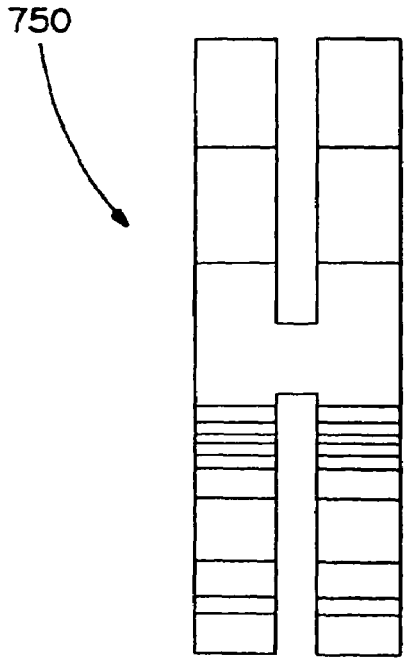
FIG. 37 is a right side view of the compression connector of FIG. 33.
Figure 38:
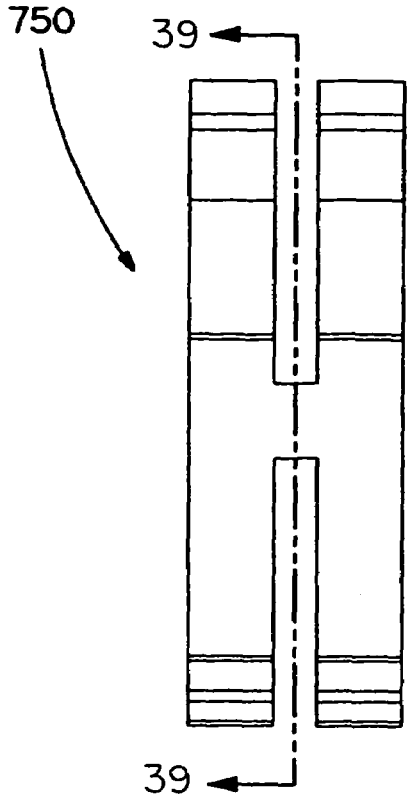
FIG. 38 is a left side view of the compression connector of FIG. 33.
Figure 39:
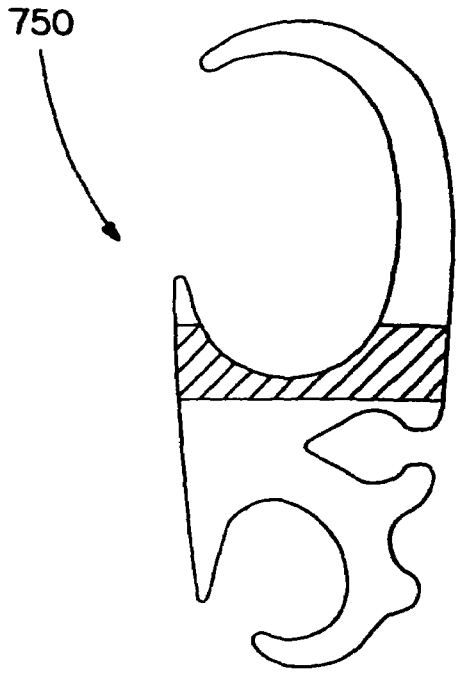
FIG. 39 is a cross-sectional view taken along lines 39—39 of FIG. 38.
Figure 40:
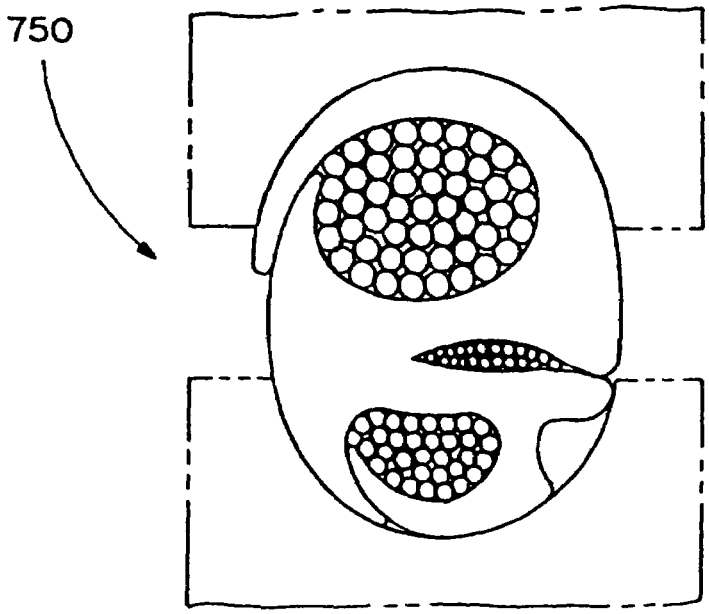
FIG. 40 is a front view of the compression connector of FIG. 33, after crimping two different sizes tap wires.
Figure 41:
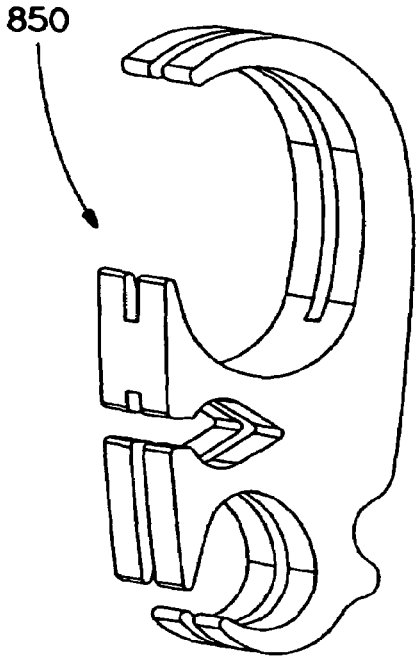
FIG. 41 is a left front perspective view of a compression connector according to a ninth embodiment of the present invention.
Figure 42:
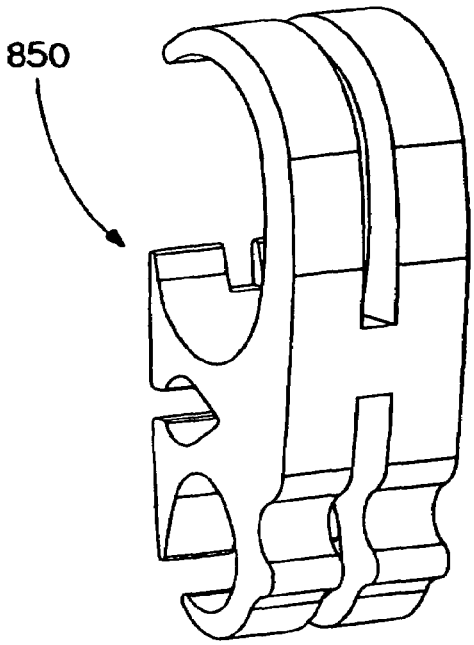
FIG. 42 is a right side perspective view of the compression connector of FIG. 41.
Figure 43:
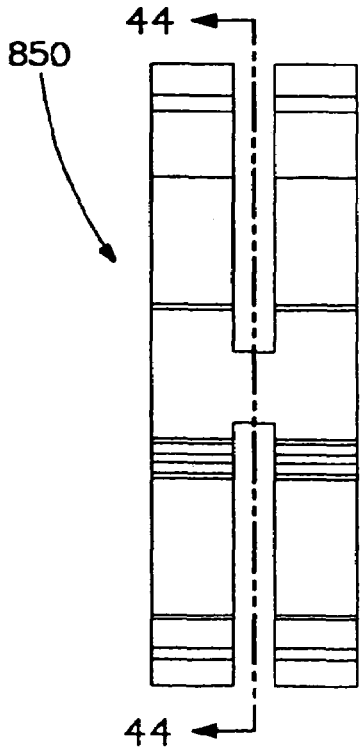
FIG. 43 is a left side view of the compression connector of FIG. 41.
Figure 44:
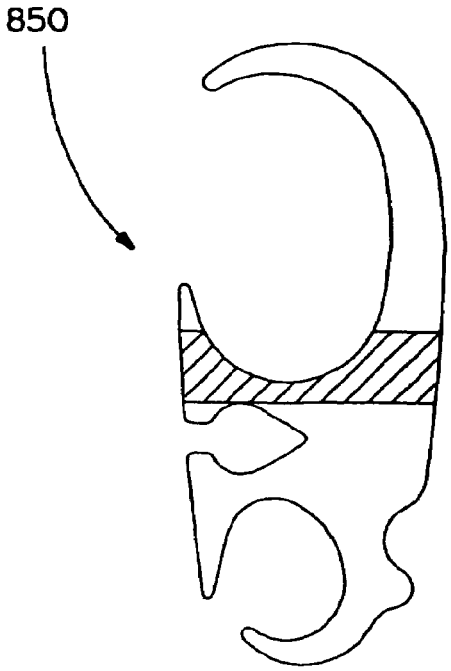
FIG. 44 is a cross-sectional view taken along lines 44—44 of FIG. 43.

Moreover, as best seen in FIG. 13, a blend 256 is added to the smallest wire port to improve the overall quality of the wire crimp. Rounded edges on both sides of compression connector 250 prevent nicking of the crimped wires by sharp edges in the port, which is advantageous for ports that accept extremely small wire sizes. However, compression connector 250 functions similarly to compression connector 150 illustrated in FIGS. 9–12.

A fourth embodiment of the present invention is illustrated in FIGS. 17–20. As shown in FIGS. 17–20, a split multi-tap compression connector 350 is substantially the same as compression connector 250 illustrated in FIGS. 13–16, except that hole 352 has replaced notch 252 and tab 254. When compression connector 350 is crimped, hole 352 collapses under pressure exerted by the opposite sides of the wire port entrance. Thus, the entire port collapses tighter on the crimped wire and holds the wire more securely. However, compression connector 350 functions similarly to compression connector 250 illustrated in FIGS. 13–16.

A fifth embodiment of the present invention is illustrated in FIGS. 21–24. As shown in FIGS. 21–24, a split multi-tap compression connector 450 is substantially the same as compression connector 50 illustrated in FIGS. 1–8, except that tap wire ports 88, 88' are opposite tap wire ports 86, 86'. Moreover, notch 452 and tab 454 have been positioned above tap wire port 88. However, compression connector 450 functions similarly to compression connector 50 illustrated in FIGS. 1–8.

A sixth embodiment of the present invention is illustrated in FIGS. 25–28. As shown in FIGS. 25–28, a split multi-tap compression connector 550 is substantially the same as compression connector 50 illustrated in FIGS. 1–8, except that tap wire ports 88, 88' are positioned below tap wire ports 86, 86'. However, compression connector 550 functions similarly to compression connector 50 illustrated in FIGS. 1–8.

A seventh embodiment of the present invention is illustrated in FIGS. 29–32. As shown in FIGS. 29–32, a split multi-tap compression connector 650 is substantially the same as compression connector 550 illustrated in FIGS. 25–28, except that tap wire ports 86, 86', 88, 88' are on the opposite side of the compression connector. However, compression connector 650 functions similarly to compression connector 550 illustrated in FIGS. 25–28.

An eighth embodiment of the present invention is illustrated in FIGS. 33–40. As shown in FIGS. 33–40, a split multi-tap compression connector 750 is substantially the same as compression connector 50 illustrated in FIGS. 1–8, except that tap wire ports 88, 88' have been removed from compression connector 50. Compression connector 750 is utilized to accommodate large size wires. However, compression connector 750 functions similarly to compression connector 50 illustrated in FIGS. 1–8.

A ninth embodiment of the present invention is illustrated in FIGS. 41–44. As shown in FIGS. 41–44, a split multi-tap compression connector 850 is substantially the same as compression connector 750 illustrated in FIGS. 33–40, except that tap wire ports 86, 86' have been positioned on the opposite side of the compression connector. However, compression connector 850 functions similarly to compression connector 750 illustrated in FIGS. 33–40.

The disclosed invention provides split multi-port compression connectors having improved retention of tap wires before and during the crimping operation. It should be noted that the above-described illustrated embodiments and preferred embodiments of the invention are not an exhaustive listing of the form such a compression connector in accordance with the invention might take; rather, they serve as exemplary and illustrative of embodiments of the invention as presently understood. By way of example, and without limitation, a compression connector having more than three tap wire ports is contemplated to be within the scope of the invention. Many other forms of the invention are believed to exist.

The invention claimed is:

1. A compression connector for securing wires therein, the compression connector comprising:

a body portion having a first substantially C-shaped hook and a first ramp extending therefrom to form a main wire port, the body portion further having a second substantially C-shaped hook and a second ramp extending therefrom to form a first tap wire port;

wherein the body portion has a second tap wire port positioned between the main wire port and the first tap wire port.

2. The compression connector of claim 1, further including a third tap wire port positioned between the main wire port and the first tap wire port.

3. The compression connector of claim 1, wherein the body portion includes a bump positioned between the first tap wire port and the second tap wire port.

4. The compression connector of claim 1, wherein the body portion includes a notch and a tab positioned adjacent the second tap wire port.

5. The compression connector of claim 1, wherein the second tap wire port includes a blend.

* * * * *